US005199686A

United States Patent [19]

Fletcher

[11] Patent Number: 5,199,686

[45] Date of Patent: * Apr. 6, 1993

[54] NON-CONTINUOUS BASE GROUND LEVEL AUTOMOTIVE LIFT SYSTEM

[75] Inventor: Robert H. Fletcher, Glenwood, N.J.

[73] Assignee: Advantage Lift Systems Inc., San Diego, Calif.

[ * ] Notice: The portion of the term of this patent subsequent to Mar. 17, 2009 has been disclaimed.

[21] Appl. No.: 815,748

[22] Filed: Jan. 2, 1992

Related U.S. Application Data

[63] Continuation-in-part of Ser. No. 643,021, Jan. 18, 1991, Pat. No. 5,096,159.

[51] Int. Cl.[5] ..... B66F 7/12

[52] U.S. Cl. ..... 254/90; 254/10 R; 254/89 H; 187/8.72

[58] Field of Search ..... 254/8 R, 8 B, 8 C, 9 R, 254/9 B, 9 C, 10 R, 10 B, 10 C, 89 R, 89 H, 90, 124, 122; 187/8.41, 8.72

[56] References Cited

U.S. PATENT DOCUMENTS 4,763,761 8/1988 McKinsey et al. ..... 254/89 R 4,848,732 7/1989 Rossato ..... 254/90

FOREIGN PATENT DOCUMENTS 2084541 10/1980 United Kingdom ..... 254/90

*Primary Examiner*—Robert C. Watson

*Attorney, Agent, or Firm*—Melvin K. Silverman

[57] ABSTRACT

An automotive lift system includes a longitudinal series of transverse pairs of left and right rigid lifting legs, neither any legs of said pairs of legs nor any longitudinally successive legs having any on-ground connection therebetween, each of the legs having a top and a bottom, each bottom of each leg having, pivotally secured to it, a planer base which is anchored upon an on-ground floor. The system also includes left and right longitudinal vehicle wheel support platforms, the platforms having a pivotal connection relative to the respective tops of each of the respective pairs of left and right rigid legs. Also included are fluid piston and cylinder power assemblies within at least one pivotal connection within one of the series of left and right lifting legs, for selectively changing the effective length of the pistons of the power assemblies to correspondingly and synchronously modify the angulation between each piston, its corresponding lifting leg, and its respective platform, to synchronously control the height of each platform relative to each other.

11 Claims, 11 Drawing Sheets

NON-CONTINUOUS BASE GROUND LEVEL AUTOMOTIVE LIFT SYSTEM

REFERENCE TO RELATED APPLICATION

This case is a continuation-in-part of application Ser. No. 07/643,021 filed Jan. 18, 1991, now U.S. Pat. No. 5,096,159 entitled Automotive Lift System.

BACKGROUND OF THE INVENTION

Automotive lift systems have been long known in the art. However, during approximately the last fifteen years, the primary system used to perform maintenance and service upon and from underneath of automotive vehicles has changed from an in-ground post lift system to a so-called on-ground system.

One reason for a ground level system lies in its environmental advantages. More particularly, the U.S. Environmental Protection Agency (EPA) and the U.S. Occupational Safety and Hazards Agency (OSHA) have imposed strict and costly regulations relating to most forms of on-site excavation that include the use or storage of toxic chemicals in the ground. In the prior art of in-ground post-lift systems, it was necessary to store hydraulic, and other potentially hazardous materials, underground. Accordingly, and primarily as a response to such governmental regulation, the trend in the last fifteen years has been strongly away from in-ground post lift systems and in the direction of above-ground lift systems.

Among the latter category, a type of lift known as the parallelogram lift has appeared. The term parallelogram is employed because, when viewed from the side, the profile of the structure exhibits the configuration of a parallelogram. This style of lift is unique in the above-ground market in that it has eliminated the need for central posts. Such posts are undesirable in that they consume room and create potential obstruction to workers. Therefore, the elimination of posts has brought about a saving of space and provided enhanced efficiency over prior art in-ground systems. However, the parallelogram lift has encountered market resistance in the United States due to reasons of its newness of design and concerns in respect to its safety, notwithstanding the fact that the parallelogram-style lift is, by most analyses, the safest lift manufactured today. Another factor is that existing parallelogram systems make use of longitudinal on-ground base elements between the lifting legs which inhibit left-to-right and front-to-back access to the vehicle. Also, a prior art parallelogram lift, upon closure during descent, is capable of cutting hoses and cords in the work area.

That prior art most representative of such parallelogram automotive lift systems known to the inventor comprises the following:

U.S. Pat. No. 3,330,381 (1967) to Halstead, entitled Vehicle Lift; U.S. Pat. No. 4,447,042 (1984) to Maiser, entitled Vehicle Lift; and U.S. Pat. No. 4,848,732 (1989) to Rossato, entitled Lifting Ramp.

With respect to the system hydraulics, the prior art is represented by U.S. Pat. No. 2,764,869 to Scherr which teaches a primitive, mechanical fluid control of a generally related hydraulic circuit. Such a system cannot provide the precision or durability required in the present application.

It is therefore a goal of the present invention to effect the elimination of baseframes, that is, cross-connecting or cross-coupling elements between left and right, and front and back, rows of hydraulic lifting legs that are used in existing parallelogram lifts, and which impede front-to-rear and right-to left access to the elevated vehicle.

SUMMARY OF THE INVENTION

The instant automotive lift system comprises a non-continuous base ground level automotive lift system including a longitudinal plurality of transverse pairs of left and right, rigid lifting legs, neither any legs of said pairs of legs nor any longitudinally successive legs having any on-ground connection therebetween, each of said legs having a top and a bottom, each bottom of each leg having, pivotally secured therewith, a planer base which is anchored upon an on-ground floor. The system also includes left and right longitudinal vehicle wheel support platforms, said left and right wheel platforms having a pivotal connection relative to the respective tops of each of said respective pairs of left and right rigid legs, and further includes fluid piston and cylinder power means, within at least one pivotal connection within one each of said left and right pluralities of lifting legs, for selectively changing the effective length of the piston of said power means to correspondingly and synchronously modify the angulation between each piston, its corresponding lifting leg and its respective platform, to thereby synchronously control the angulation and height of the platforms relative to each other and to said on-ground floor.

It is an object of the present invention to provide a parallelogram automotive vehicle lift system having no transverse torsion bar or other, transverse connecting means between the left and right sides of such system, or having any front-to-back baseframe.

It is another object of the invention to provide a parallelogram ground level lift system having side-to-side and front-to-back access to an elevated vehicle without any on-ground horizontal base elements between legs.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
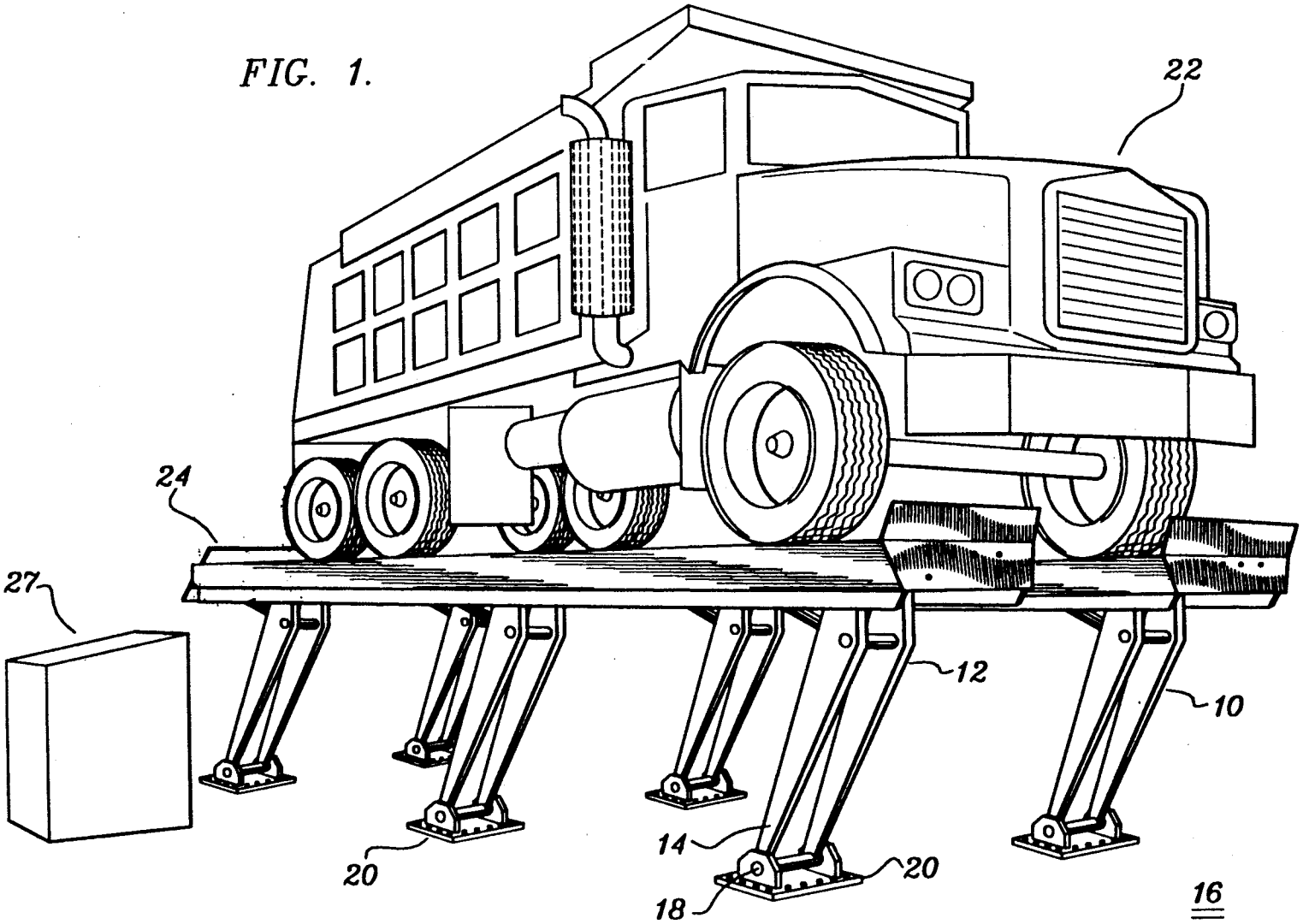
FIG. 1 is a perspective view of the inventive system showing a vehicle thereupon.
Figure 2:
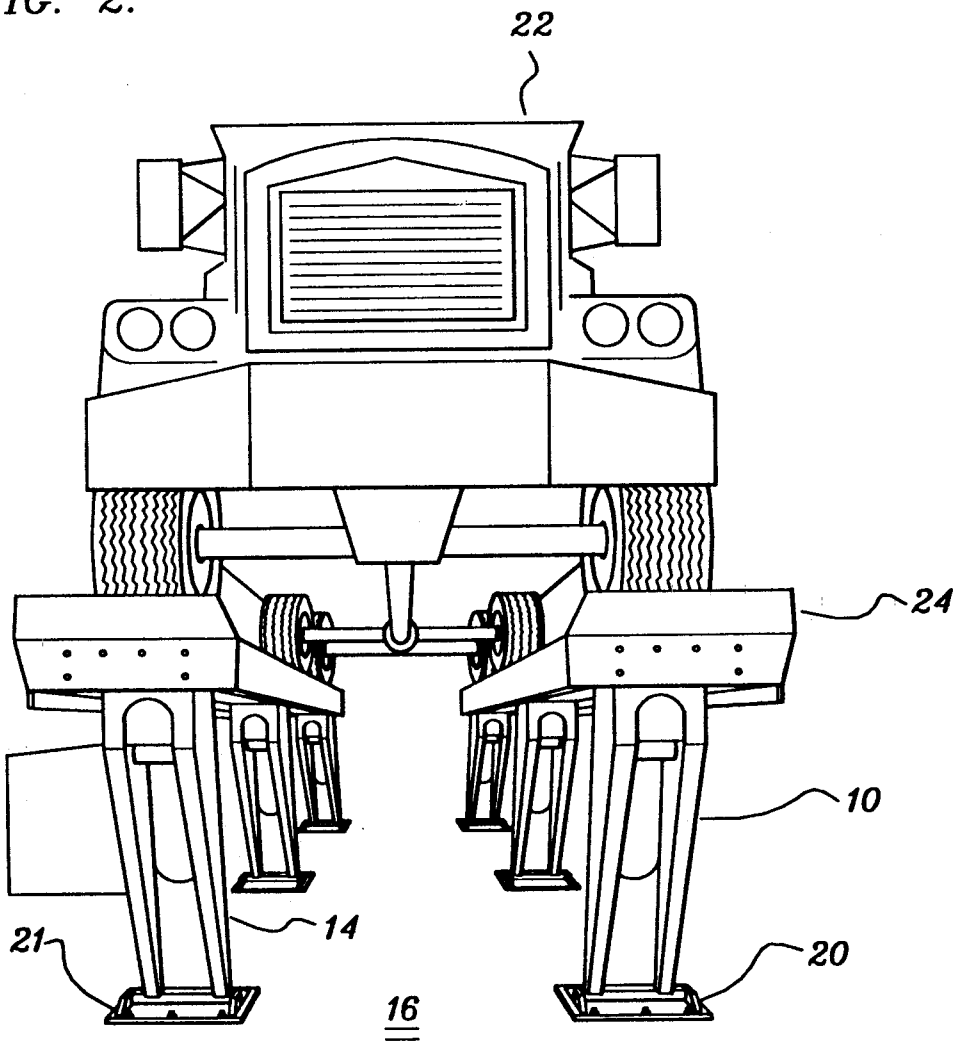
FIG. 2 is a front elevational view of the illustration of FIG. 1.

With reference to the views of FIGS. 1 thru 6, the inventive automotive lift system is seen to include a longitudinal plurality of transverse pairs of left and right rigid lifting legs 10, each of said legs having a top 12 and a bottom 14. As may be noted, the bottom of each leg is anchored upon a floor 16 through a pivot point 18 within a planer base 20. Each of said bases 20 is secured, typically by leveling screws 21, to the floor 16 which is generally a high impact concrete. The plane of said bases relative to floor 16 may be adjusted thru the use of the leveling screws 21 and related lock nuts.

A distinctive feature of the instant invention resides in the fact that, unlike prior art devices, each base 20 is mechanically independent from every other base in both the longitudinal and transverse directions. Accordingly, access to a vehicle 22 may be readily accomplished to the underside of the vehicle, either transversely (from left or right) or longitudinally (from front or back).

Figure 3:
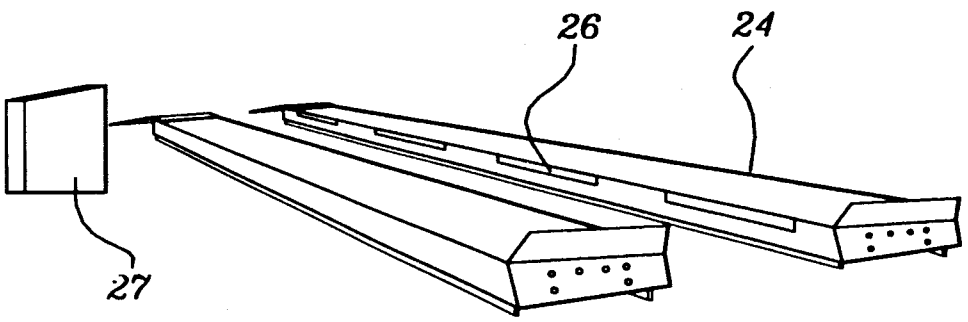
FIG. 3 is a perspective view of the vehicle wheel platforms employed in the inventive system, without a vehicle thereon.
Figure 5:
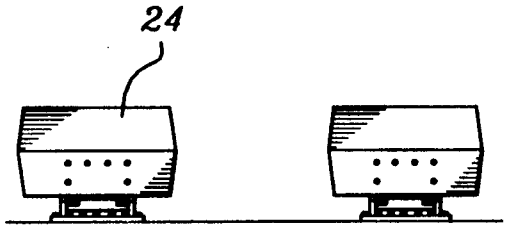
FIG. 5 is a front plan view of FIG. 4.

In the view of FIG. 3, it is noted that each wheel platform 24 is provided with lamps 26, which provide lighting to the platforms.

With further reference to the views of FIGS. 1 thru 6, and FIG. 8, the inventive system is seen to include left and right longitudinal vehicle lift platforms 24. Said platforms 24 are rotationally moved at point 34 of top 12 of legs 10.

A hydraulic piston 28 (see FIGS. 6 and 8) is selectably extended or withdrawn relative to a cylinder 30, employing a controller 27 (see FIG. 1). The right end of cylinder 30 is rotationally connected to platform 24 at cylinder pivot point 29, while piston 28 is rotationally connected to leg 10 at piston pivot point 25. As may be appreciated, the function of hydraulic piston 28 and its cylinder 30 is to selectively alter the angle between leg 10 and platform 24 to thereby change the height and angulation of the platform 24 relative to floor 16. This is achieved by a dynamic co-action between a base pivot point 18, piston pivot point 25, cylinder pivot point 29 and leg top pivot point 33. It is noted that in a preferred embodiment, one pair of cylinders 30 and 31 (see FIGS. 7, 10 and 11) is provided for each pair of lifting legs 10.

An interlock element (see FIGS. and 9) 35 will engage the housing of cylinder 30 in the event of a failure of piston 28, as is more fully described in my co-pending application Ser. No. 07/758,118.

In operation, a typical height of the wheel platforms above the floor will be sixty-three inches when piston 28 is extended to its maximum relative to cylinder 30.

Figure 7:
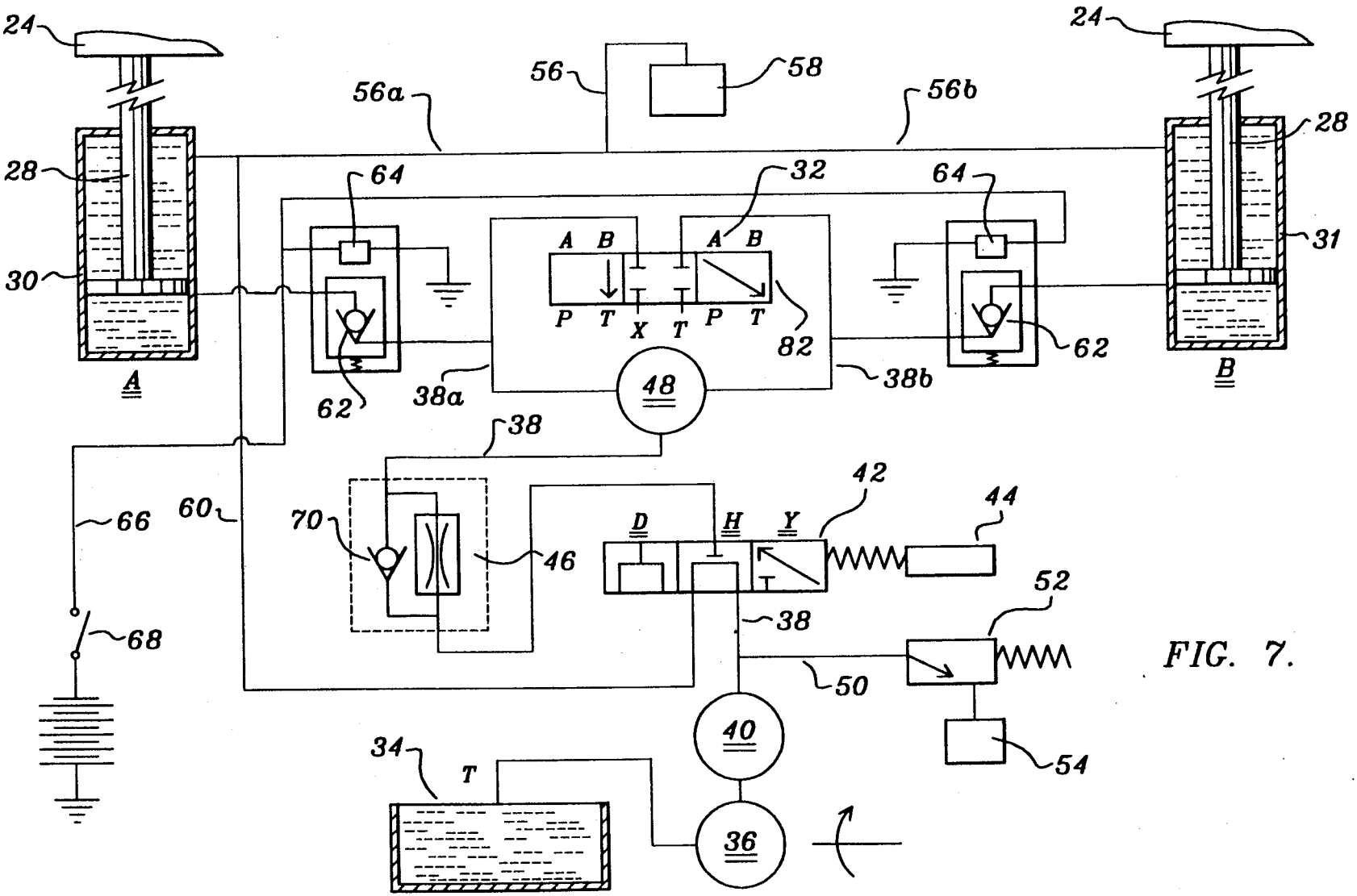
FIG. 7 is a basic hydraulic circuit schematic applicable to the invention.

In the hydraulic schematic view of FIG. 7 is shown said hydraulic cylinders 30 and 31, as well as proportioning valve 32 (later described in fuller detail) and an hydraulic reservoir tank 34. The pressurized hydraulic fluid from tank 34 is pumped under pressure by a pump 36 which may be driven, through any of a variety of convenient power sources, to a common pressure supply line 38.

Connected in series to said line 38 are a filter 40, a general system control valve 42 (including a manual override 44) and a pressure-compensated flow control valve 46 which serves to maintain a near-constant rate of return flow in line 38 regardless of the load upon cylinders 30 and 31. Also shown in FIG. 7 is an hydraulic flow equalizer or divider 48. Connected into the supply line 38, between filter 40 and said valve 42, is a bypass line 50 which, in turn, is connected to a relief valve 52 which discharges into a reservoir 54 which, while shown to be separate from said tank 34, is preferably the same physical element. Further, valve 52 may be an integral part of the afore-said valve 42 in which case no external conduits would be required.

It is noted that flow divider 48 may be of a type comprising two hydraulic gear motors mechanically interconnected to rotate in unison, said motors being supplied through a common inlet and delivering to two outlets. Connected between the gear motors and the two outlets may be pressure-balancing elements requiring both sets of gear motors to work against the same fluid pressure. These elements may be an integral part of the flow divider 48. The aforesaid common inlet is connected to said supply line 38 and the said outlets are connected to branch lines 38*a* and 38*b* which, in turn, are connected to the lower ends of said cylinders 30 and 31 respectively. Accordingly, under normal conditions the flow divider 48 is adapted to supply equal volumes of hydraulic fluid at the pressure to which the system is set, to the lower ends of cylinders 30 and 31.

The upper ends of said cylinders are connected to branch lines 56*a* and 56 which are connected by a common line 56 to tank 58, shown to be separate from, but which also is preferably the same, as tank 34. Also connected to said lines 56*a* and 56*b* and, hence, to the upper ends of cylinders 30 and 31 respectively is a line 60 adapted to be connected to the main pressure supply line 38 through valve 42.

It is to be understood that said branch lines 38*a* and 38*b* feed the lower ends of cylinders 30 and 31 through check valves 62 which normally function to prevent back flow of hydraulic fluid to said cylinders. However, said check valves may be electronically unseated to permit this return flow, as by associated solenoids 64 connected in a common electrical circuit 66 adapted to be energized upon closing of a normally open switch 68.

Said valve 42 is, in manual mode, a three-way valve which may be operated in three positions which are as follows:

In an "up" position U it passes high pressure fluid to the system through line 38 to said flow divider 48 and, thereby, provides equal fluid pressure to the lower ends of cylinders 30 and 31 while simultaneously blocking-off the supply of hydraulic fluid to the upper ends of the cylinder through said line 60. Concurrently, upper ends of the cylinder exhaust through lines 56, 56*a* and 56*b* to tank 34. Thusly, in the "up" position of valve 42, the cylinders apply a lifting effect to platforms 24. It is noted that the system pressure is determined by the load upon the cylinders, with a maximum value determined by the relief valve setting. Further, in the "up" position U the fluid pressure by-passes the variable restriction in the flow control valve 46 through a ball check valve 70 which is an integral part of the flow control valve 46.

In the "hold" position H, in which the valve 42 establishes communication between pressure lines 38 and 60 (assuming the check valves 62 have been unseated), the lower ends of cylinders 30 and 31 will exhaust through branch line 38*a*, 38*b*, flow divider 48, pressure compensated flow control valve 46, and valve 42, to line 60.

When the pistons of the cylinders are lowered, the "down" position D part of the fluid flowing through line 60 operates to increase the volume at the top of the cylinders which, at that point, act as auxiliary reservoirs. The remainder of the fluid passes to the main reservoir (tank 34) through line 56. Any fluid supplied by the pump 36 will also pass via lines 56 and 60 to the upper ends of the cylinders and eventually to the main tank 34. The unseating of the check valves 62 which is necessary to permit the lower ends of the cylinders to exhaust, is effected by a connection (not shown) between the valve 62 and switch 68, when said valve 62 is moved to its aforesaid "down" position D, thusly ensuring the unseating of the check valves 62 before throttling action occurs in the spool of valve 42.

Pressurized fluid passing through the flow control valve 46 in the "down" position is restricted to permit a predetermined near-constant rate of flow regardless of cylinder fluid pressures. This action is effected by cylinder pressure fluid acting on a spring biased piston which, in turn, operates a calibrated piston 72 to maintain constant flow. Other means for achieving such constant flow are known in the art.

To the extent described above there is provided an hydraulic system for supplying equal volumes and fluid pressures to the lower ends of the cylinders, for establishing and maintaining the fluid pressures contained in the cylinders, and for bleeding fluid from the lower ends of the cylinders to an auxiliary reservoir in the upper ends of the cylinders and to the main reservoir.

It is conventional in the prior art of hydraulics to provide means to mechanically equalize travel of the pistons of the cylinders in either direction under conditions of equal platform loading or in which the differential between left and right platform loadings is so small that such differential can be safely discarded. However, in the instant inventive system, it must, as a matter of safety, be anticipated that vehicles will be placed upon the system in which the left-to-right load differential is great. Resultant therefrom, internal leakage through one of the gear units of the flow divider 48, the outlet of which is connected to the heavier-loaded cylinder, will produce an error in the division of flow and, hence, greater travel of the piston/cylinder carrying the lesser load will occur. Such a result could be potentially catastrophic in the automotive area, in which vehicles such as trucks weighing as much as seventy-five tons may be elevated by a system in accordance with the present invention. That is, while such a low differential and resultant error may be small in itself, it can nonetheless be transmitted to, and manifest itself in, serious bending strains imposed upon the platform and other travelling and/or supporting members and structures. Also, in that this error becomes cumulative during repeated operating cycles, the resultant error could prove to be of relatively large magnitude. Accordingly, it is highly desirable to supplement the normal action of flow divider 48, acting as a primary system control for supplying equal volumes of pressure fluid to the jack cylinders under normal (equal) load conditions, with an additional servo-control system capable of sensing any error in or through the primary control occurring during abnormal (high low differential) conditions to thereby effectively remove or compensate for such potential errors, and capable of rapidly and re-iteratively responding to such errors.

The above requirement to provide an error correction means to compensate for pressure, movement and rate of movement differentials between the respective cylinders 30 and 31, is met by providing external intelligence to said proportioning valve 32, shown to the right of FIG. 7. Said proportioning valve and its operation with reference to the preferred embodiment of the invention is more fully described below with reference to the description of FIG. 12. However, it is noted that proportioning valve 32, in a preferred embodiment, comprises a four-ported valve, for example, a four/-three bi-directional hydraulic valve. The proportioning valve includes a Port A fluidly connected to cylinder 30, a Port B fluidly connected to cylinder 31, a pressure port P, and a tank Port T fluidly connected to said reservoir or tank 34.

As may be noted by the symbol X involve 32 in FIG. 7, the pressure Port P is blocked so that fluid removed from Port A or B can be returned through return line 38 directly to tank 34. That is, pressure Port P is blocked from tank 34 while Port A is blocked from Port B. These positions are shown in the left and right squares of valve 32. This concept is further shown in the view of FIG. 11. It may be seen that the pressure Port P is blocked from Tank T, while Port A is blocked from Port B. Resultingly, as may be noted, only two positions and, therefore, two hydraulic circuits, can be effected by the operation of proportioning valve 32. The first possible position is that shown in the left hand block of proportioning valve 32. Therein, the fluid flow from Port A to pressure Port B is constant, while the flow between Port B and Tank T is a variable, i.e., in this position, and the resultant hydraulic circuit, only the quantity of hydraulic fluid to Port B, corresponding to cylinder 31, can be varied.

In the second possible position of proportioning valve 32, shown in the right hand block of valve 32 in FIG. 7, the flow from Port B to Port P is a constant, while the flow from Port A to Tank T is a variable. That is, in the second position, the amount of fluid to or from Port A, which supplies cylinder 30, may be varied.

In the inventive control system it has been determined that, where an undesirable differential between the cylinders appears during the descent mode of the system, one must, through sensing means described below, identify the slower moving of the two cylinders. Once this is done the above described second position is employed if the cylinder associated with Port A is the slower-moving side of the system. The above described first position of the proportioning valve is employed if the cylinder of Port B is the slower-moving side during descent. After it is determined which is the slower moving side during descent, fluid is withdrawn by the proportioning valve from that cylinder, to speed it up relative to the other cylinder.

If a differential error is sensed during ascent, the faster moving piston is also focused upon. Said first position (the left hand side of the proportioning valve) is employed if the cylinder of Port B is the faster moving, and position two is selected if cylinder Port A is the faster moving. Then, once the faster moving cylinder is ascertained, fluid is withdrawn from that cylinder and returned to Tank T to slow it down relative to the other piston.

External the electronic control of proportioning valve is accomplished through the function of two linear variable differential transformers (LVDT) or linear encoders 74 and 75, the functions of which are more fully described below.

Figure 9:
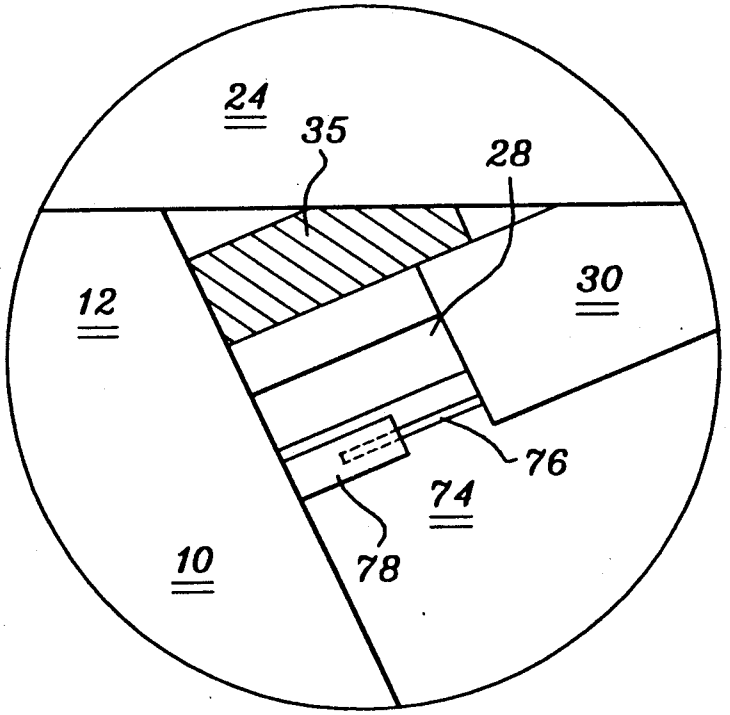
FIGS. 8 and 9 are successively enlarged views of the pivotal connection of FIG. 6 between a wheel platform and a top of a lifting leg, showing therein a piston and cylinder power means.
Figure 8:
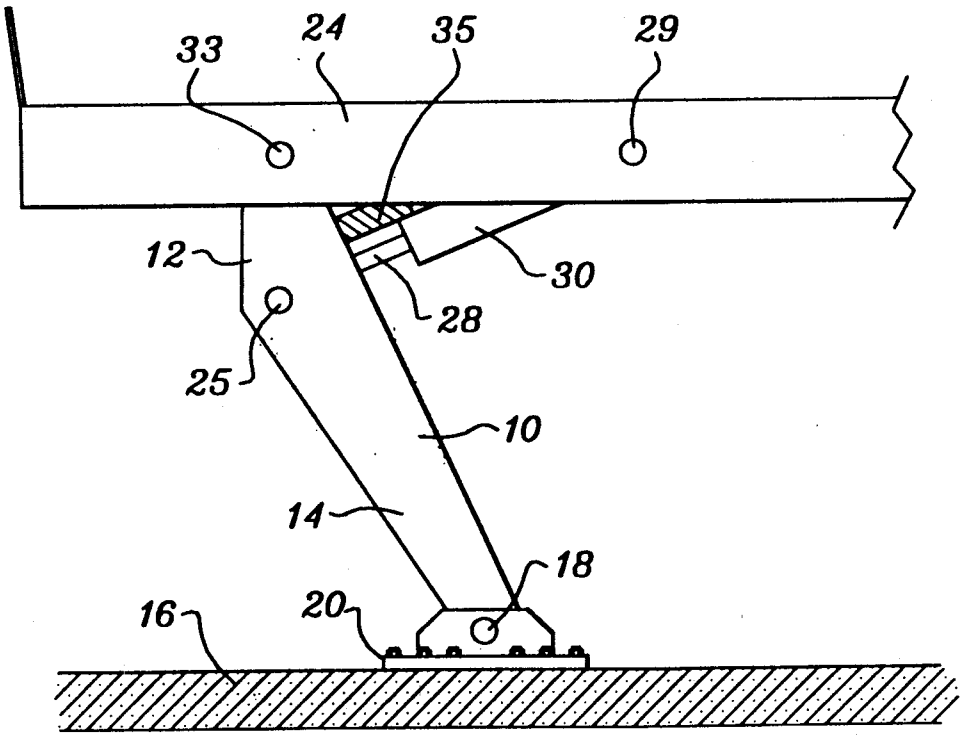
Figure 10:
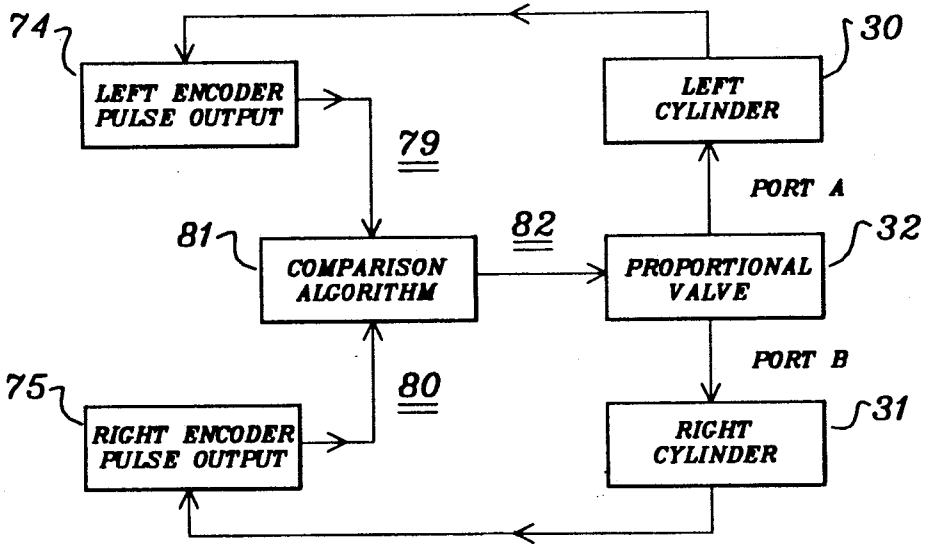
FIG. 10 is a software flowchart of a program for synchronously modifying and controlling the angulation and height of each platform relative to the floor.

The control of the angulation and height of the platforms 24 relative to the floor 16 may be more fully appreciated with reference to FIGS. 9 and 10. More particularly, in FIG. 9 is shown linear encoder (position sensor) 74 which includes an armature 76 and a spindle 78. Within spindle 78 is a coil winding that magnetically couples with the armature 76 as a function of the extent of movement of the armature relative to the spindle. Accordingly, a digital pulse output may be obtained from the linear encoder 74 and provided to the servo-system of FIG. 10 described below.

It is noted that other devices equivalent to an LVDTs, or encoders, including linear inductive transformers, linear acoustical systems, and rotational optical encoders, may be used in lieu thereof.

In FIG. 10 is shown the use that is made of the outputs of encoders 74 and 75, at least one of which will, in a preferred embodiment, be provided at or near the pivot point 25 for at least one left and one right set of the legs 10 of plat-forms 24.

As may be noted in the flowchart of FIG. 10, the pulse outputs 79 and 80 of the left and right linear encoders are compared thru the use of an algorithm 81 which provides a correction signal 82 to proportioning valve 32.

The proportioning valve 32 will provide, as above noted, a lesser amount hydraulic fluid to left or right cylinders 30 and 31, thru valve Ports A and B, that is, to the cylinder moving too fast during ascent and too slow during descent. The result of this adjustment will then be continually monitored by the encoders, and the outputs 79 and 80 again compared. This process continues many times per second throughout the lifting and descent of the platforms 24 to assure synchronous height and angulation of the respective platforms relative to both each other. An on-off capability of the system is provided thru controller 27.

With respect to the hydraulics of the system, as above noted the bleeding-off of a small quantity of fluid from the port of the cylinder 30 or 31 that is going faster during ascent is accomplished and, similarly, the bleeding of a small amount of fluid from the port of the cylinder that is going slower during descent is accomplished, thereby causing relative deceleration of the faster cylinder, whether during ascent or descent.

Figure 11:
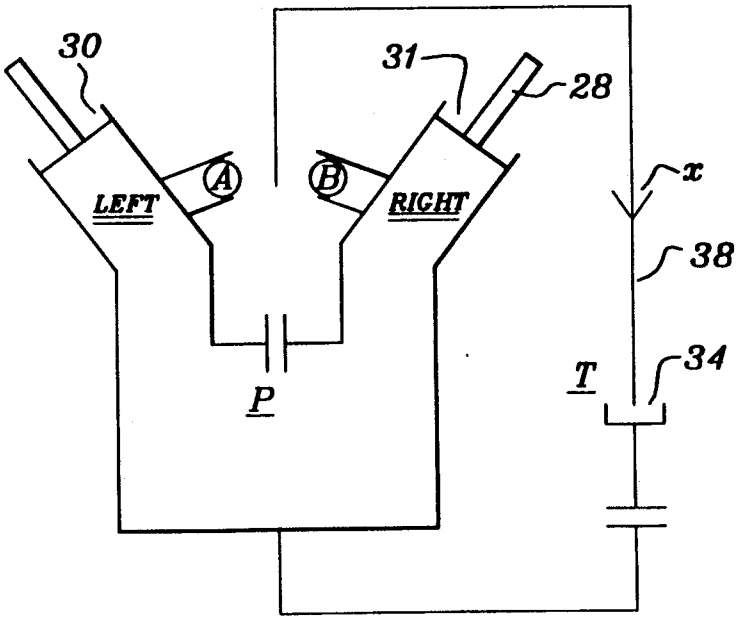
FIG. 11 is a conceptual view of the hydraulic circuit that is part of the inventive system.

This function may be represented mathematically as:

$$A+(B-x)=(T-x)$$

in which x is the amount of fluid removed from the Port B and Tank T in FIGS. 7 or 11.

In combination with the encoders 74 and 76, or other electro-optical means or electro-mechanical feedback systems, appropriate comparing may readily be effected to monitor desynchronizations of the respective lift cylinders to thereby inform the solenoids of the proportioning valve which port fluid should be removed from.

Figure 12:
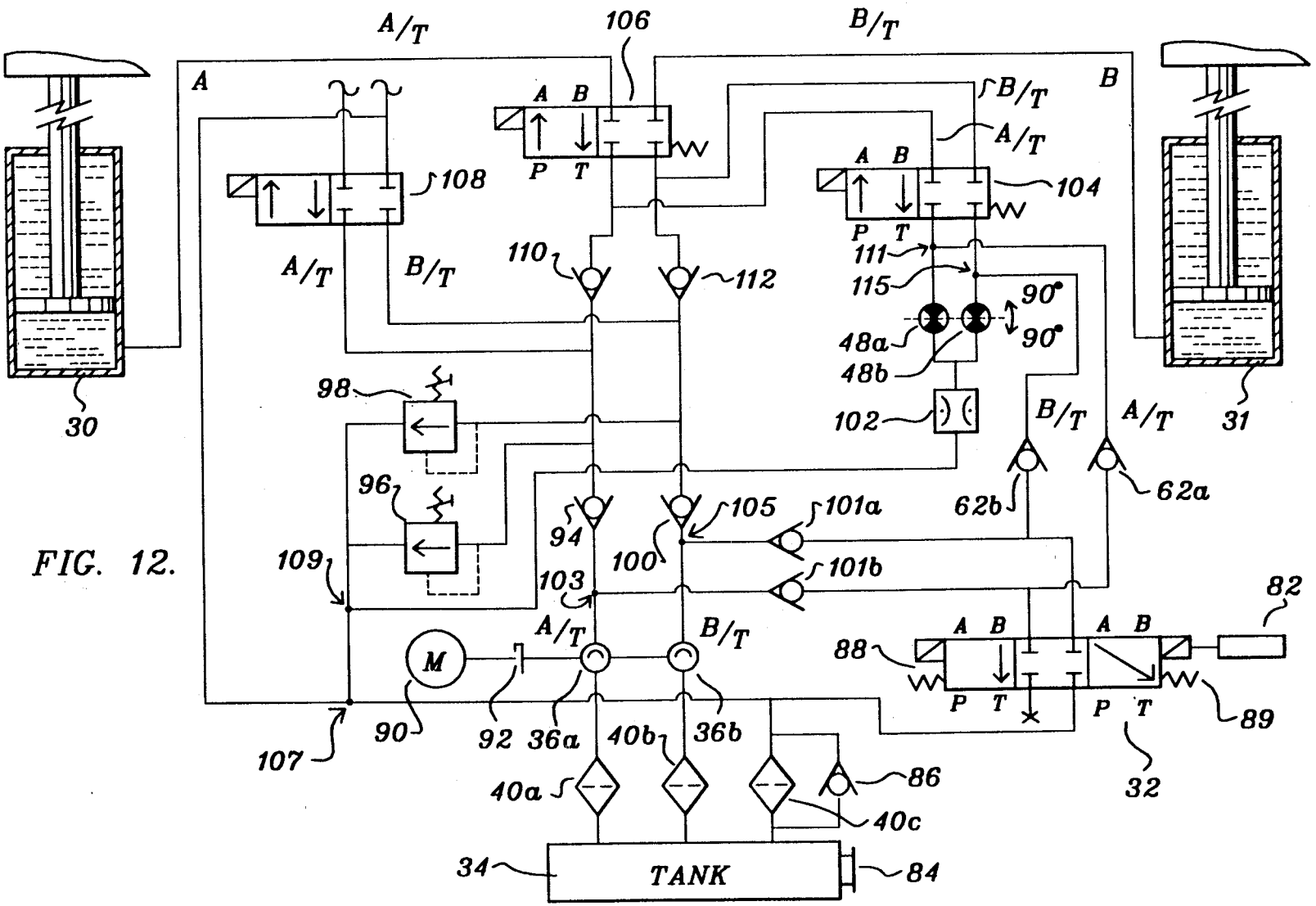
FIG. 12 is a schematic view of the type of hydraulic circuit utilized herein.

There is, in the view of FIG. 12, shown a particular schematic view of an hydraulic circuit that may used with the present lift system. At the lower right thereof is a filler breather 84 for associated tank 34. To the left thereof is shown inlet filters **40*a* and 40*b* and return filter 40*c* in which said filter 40*c* is provided with a safety relief valve 86**.

Above filter **40*c* and relief valve 86 are shown double acting solenoids 88 and 89 for moving the internal spool (not shown) of said proportioning valve 32. Said valve 32**, in its rest position, completely blocks-off flow between Port A and pressure port P, on the one hand, and Port B and Tank T, on the other hand.

When the internal spool is moved to the left, fluid is permitted to flow from Port B to Tank T, this being the typical condition when removing hydraulic fluid from Port B to change the ratio of the quantities of hydraulic fluid in the Ports A and B.

When the spool of the valve 50 is moved to the right, fluid is permitted to flow from Port A to Tank T. This is the condition when Port A must be bled, to slow or accelerate the cylinder of Port A relative to the cylinder of Port B. Accordingly, the solenoids 88 and 89 of valve 32 operate to move the internal spool of the valve between the rest position (as above described) and the modes to the left and right thereof.

Above valve 32 are check valves **101*a* and 101*b***.

At the lower middle of FIG. 12 is shown constant flow pumps **36*a* and 36*b*, pump 36*a* serving the Port A and the A/T circuit, and pump 36*b* serving the Port B and the B/T circuit. Constant flow pump 36*a* is connected to motor 90 having actuator 92. Also in hydraulic communication with pump 36*a* are check valve 94 and thru connection 103 with check valve 101*a*, Pump 36*b* is in communication with check valve 100 and thru connection 105 with check valve 101*b***.

To the middle right of FIG. 12 is shown a two-way, pressure-compensated, flow control throttle valve 102 which is in fluid communication with pressure relief valves 96 and 98 thru connection 109. Thereabove are dual rotation hydraulic flow dividers **48*a* and 48*b* which are connected by a common shaft in fluid communication with a single acting, solenoid-operated, bi-directional descent control valve 104. The output of said valve 104 is in fluid communication with another single-acting, solenoid-controlled, bi-directional valve 106 which flows directly to and from hydraulic cylinders 30 and 31 which includes to the Ports A and B. It is noted that spool-type flow control means may be substituted for flow dividers 48. Valve 106** is employed during both ascent and descent. It is the basic load-holding valve of the system.

As may be seen, proportioning valve 32 is connected in parallel with descent valve 104 thru connections 111, 113, 115 and 117 which, in turn, is connected in parallel with bi-directional valve 106, which is connected in parallel with a bi-directional valve 108, the function of which is to control an accessory jack. It is noted that valves 32, 104 and 106 thereby control the left set of legs thru the lines labelled A/T and the right set of legs thru the lines labelled B/T.

Check valves **62*a* and 62*b* preclude flow between valves 32 and 104 during ascent, while check valves 110 and 112 serve to re-direct flow to valve 104 when the valve 104 and valve 106 are open, this occurring during descent. See FIG. 14**.

Figure 13:
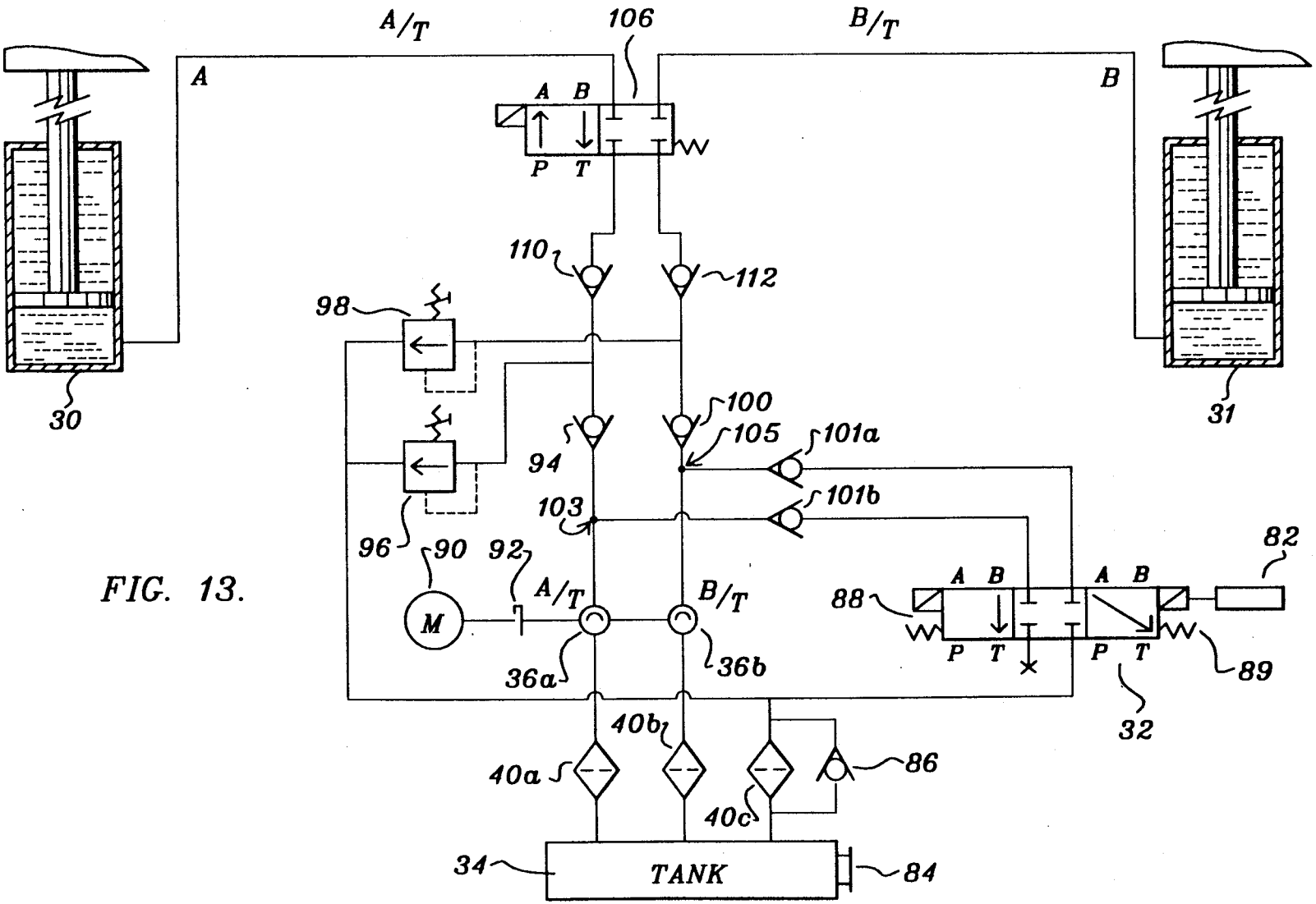
FIG. 13 is a view of that portion of FIG. 12 which relates to the ascent mode of operation of the hydraulic circuit.

With reference to FIG. 13, there are shown the portions of the hydraulic circuit of FIG. 12 which relate only to the operation of the circuit during ascent of the legs 10 of the system. Therein cylinder 30 represents all cylinders associated with left legs of each leg pair, while cylinder 31 represents all cylinders associated with the right legs of each leg pair of the system. Those portions of the circuit not employed during ascent mode have, for purposes of illustration, been removed in FIG. 13.

In FIG. 13, it is to be noted that during normal ascent, that is, ascent when there does not exist any error between the rate of travel of the left and right sides of the system, hydraulic fluid will flow directly upward from tank 34, through filters 40*a* and 40*b*, through respective pumps 36*a* and 36*b*, upward through the respective A/T and B/T lines, through check valves 94 and 100 respectively, through check valves 110 and 112 respectively, and therefrom through valve 106 and into the respective A and B ports of the cylinders 30 and 31.

In the event that the rate of travel of cylinder 30 exceeds the rate of travel of cylinder 31, hydraulic fluid is drawn from the A/T line at connection 103, passing through check valve 101*a* and, therefrom, through the proportioning valve 32 and back to tank 34. Accordingly, by withdrawing hydraulic fluid from the faster moving cylinder during ascent, its speed will be decreased, thusly bringing it into synchronization with the opposite cylinder.

In the event that cylinder 31 is determined to be the faster moving cylinder, fluid is withdrawn at connection 105 of the B/T line, through check valve 101*b* and, therefrom, through proportioning valve 32 to tank 34. In this mode of operation, that is, during ascent, descent control valve 104 (see FIG. 12) is held completely closed, thereby taking the middle right hand portion of the circuit of FIG. 12 out of operation, i.e., the flow control valve 102 and flow dividers 48 prevent return of flow to the tank.

Figure 14:
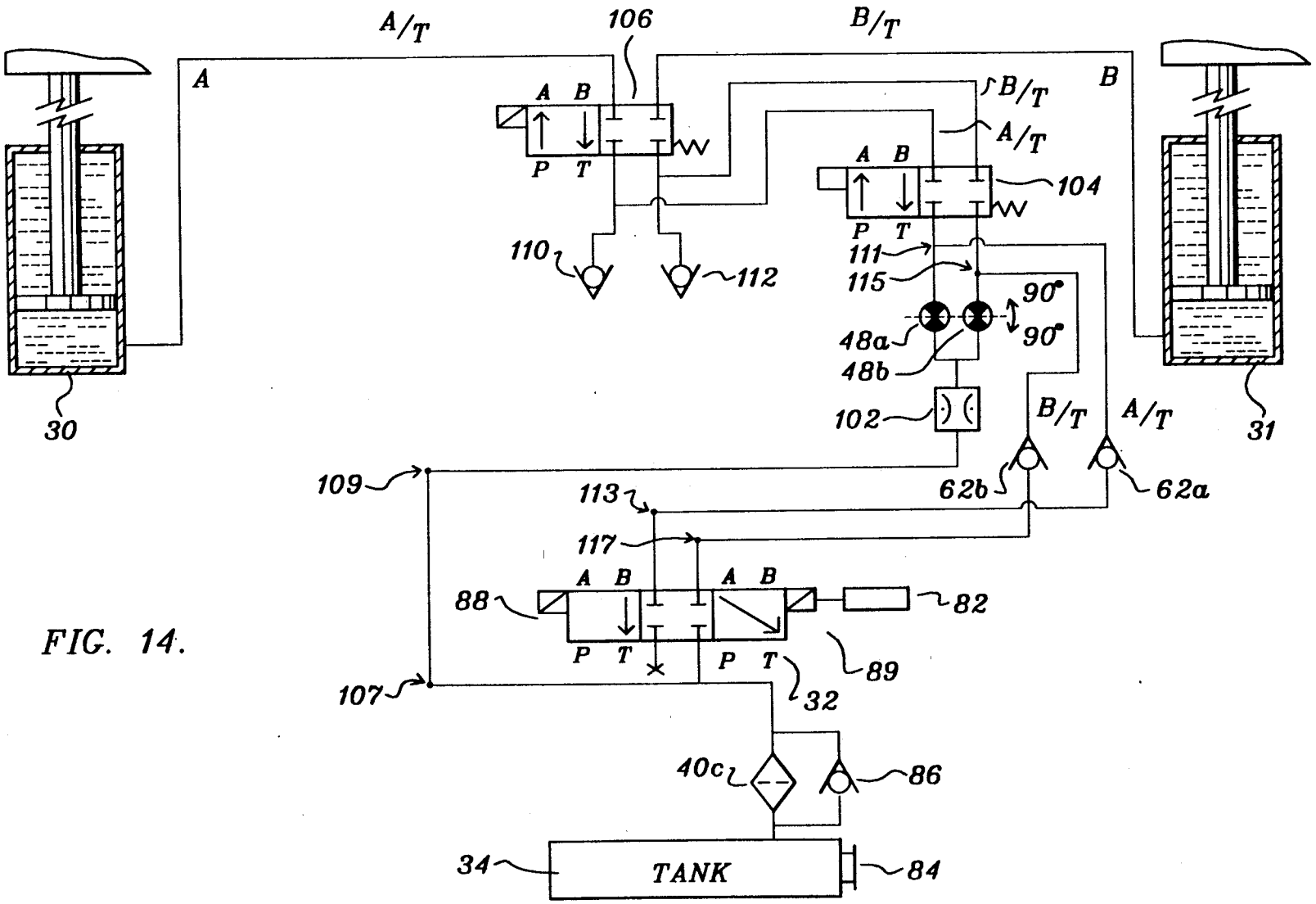
FIG. 14 is a view of that portion of FIG. 12 which relates to the descent mode of operation of the hydraulic circuit.

The function of the hydraulic circuit of FIG. 12 during descent mode is shown in FIG. 14. During normal operation, that is, the absence of any error between cylinders 30 and 31 during descent, hydraulic fluid will be supplied to the respective cylinders 30 and 31 through a primary path which, with both cylinders, begins at tank 34, passes through return filter 40*c* and, therefrom, to the left to connection 107 and, therefrom, upward to connection 109. Therefrom, hydraulic fluid, supplying both cylinders proceeds to the right to flow control valve 102 and, therefrom, just below the flow dividers 48, separates, such that hydraulic fluid for cylinder 30 passes upwardly through flow divider 48*a* while hydraulic fluid for cylinder 31 passes upwardly through flow divider 48*b*. Therefrom the flow for both A/T and B/T lines will pass through valve 104 and, therefrom, through valve 106 which valve 104 is in parallel with. Therefrom, fluid will flow through the respective lines to the respective cylinders.

When an error is detected during descent by the system shown in FIGS. 9 and 10, the correction strategy is that of speeding-up the cylinder that is descending slower by withdrawing some of the hydraulic fluid from the line corresponding to that cylinder. This will act to accelerate the otherwise slower moving cylinder because, by the removal of hydraulic fluid, hydraulic support is removed from the platform-load. Therefore the effect of gravity will operate to speed up descent of the otherwise slower moving cylinder.

The above strategy is carried-out with reference to FIG. 14 as follows:

If cylinder 30 is descending more slowly, hydraulic fluid is withdrawn at connection 111 through the right hand most line shown in FIG. 14 (labelled A/T). This is accomplished by opening check valve 62*a*. Thereby, fluid is permitted to flow downwardly through connection 113 and thereby through proportioning valve 32 to tank 34.

In the event that cylinder 31 is descending more slowly, fluid is withdrawn at connection 115, this being facilitated by opening check valve 62*b*. The withdrawn fluid from cylinder 31 continues to connection 117 and, therefrom, through proportioning valve 32 and into tank 34.

Accordingly, through the above set forth usage of the hydraulic circuit, the slower moving cylinder during descent can be accelerated through the selective withdrawal of fluid from one cylinder. This, it is noted, is made possible through the use of check valves 62*a* and 62*b* which operate to isolate flow dividers 48*a* and 48*b* from the circuit when it is necessary to withdraw fluid during the descent mode.

The hydraulic system above set forth can be operated with horsepower in the range of five to twenty five and upon 208/230/460 three phase A.C. power.

With reference to FIGS. 1 to 6 and with further regard to the mechanics of the system, the dimensions of leg bases 20 should, it has been determined, be a square having an edge dimension approximately one-third of the maximum height of the wheel platforms 24 above the floor 16, i.e., between about eighteen and twenty-one inches at the edge.

The longitudinal dimensions of the wheel platforms 24 will vary depending upon the type of vehicle to be lifted. The typical range of such lengths is between twenty-five feet and forty-two feet.

Figure 4:
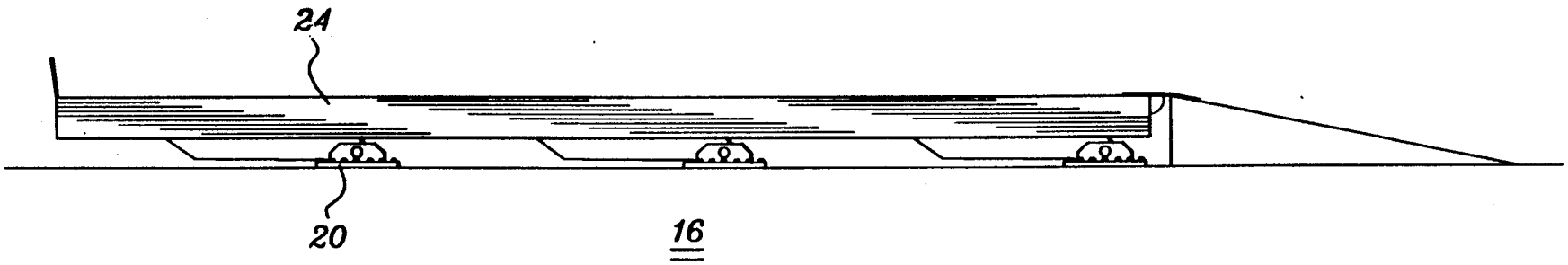
FIG. 4 is a side schematic view of the vehicle lift system, prior to elevation, without a vehicle thereupon.
Figure 6:
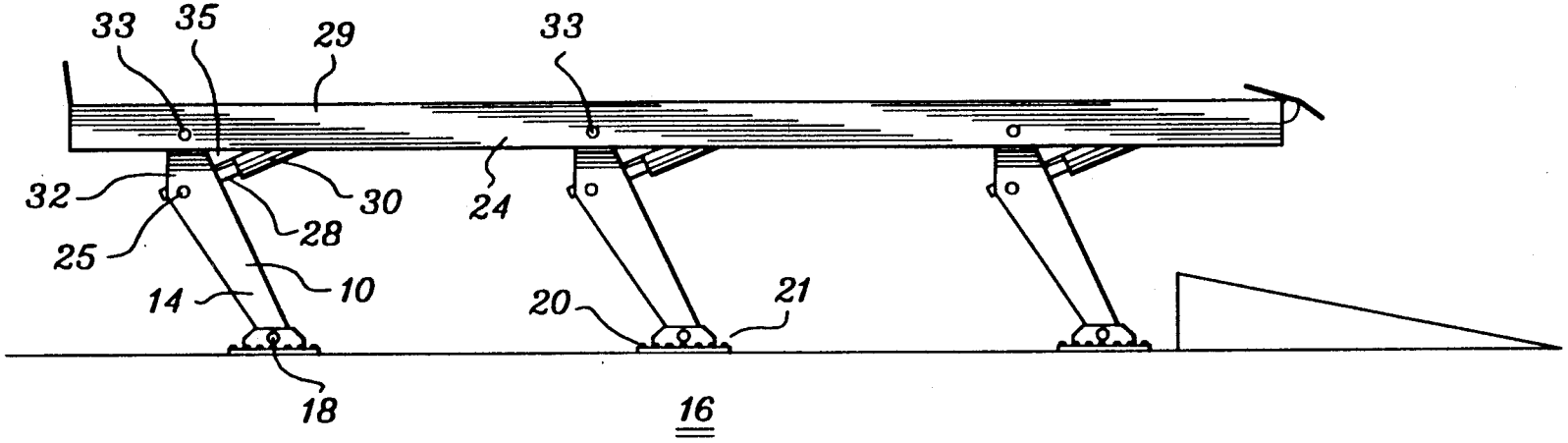
FIG. 6 is an operational schematic view showing the vehicle lift system.
Figure 16:
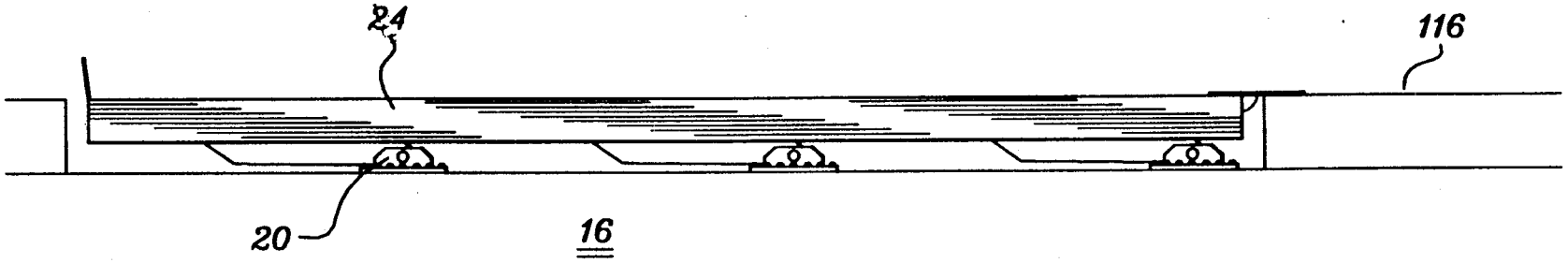
FIG. 16 is a side view, similar to FIG. 4, however, showing a recessed floor as the base for the lifting legs.

With reference to the view of FIG. 4, it is noted that the wheel platforms, when fully collapsed, occupy a height above the floor 16 of between twelve and fourteen inches. If desired, the collapsed structure can be maintained at the level of a recessed floor 116, as is shown in FIG. 16.

Figure 15:
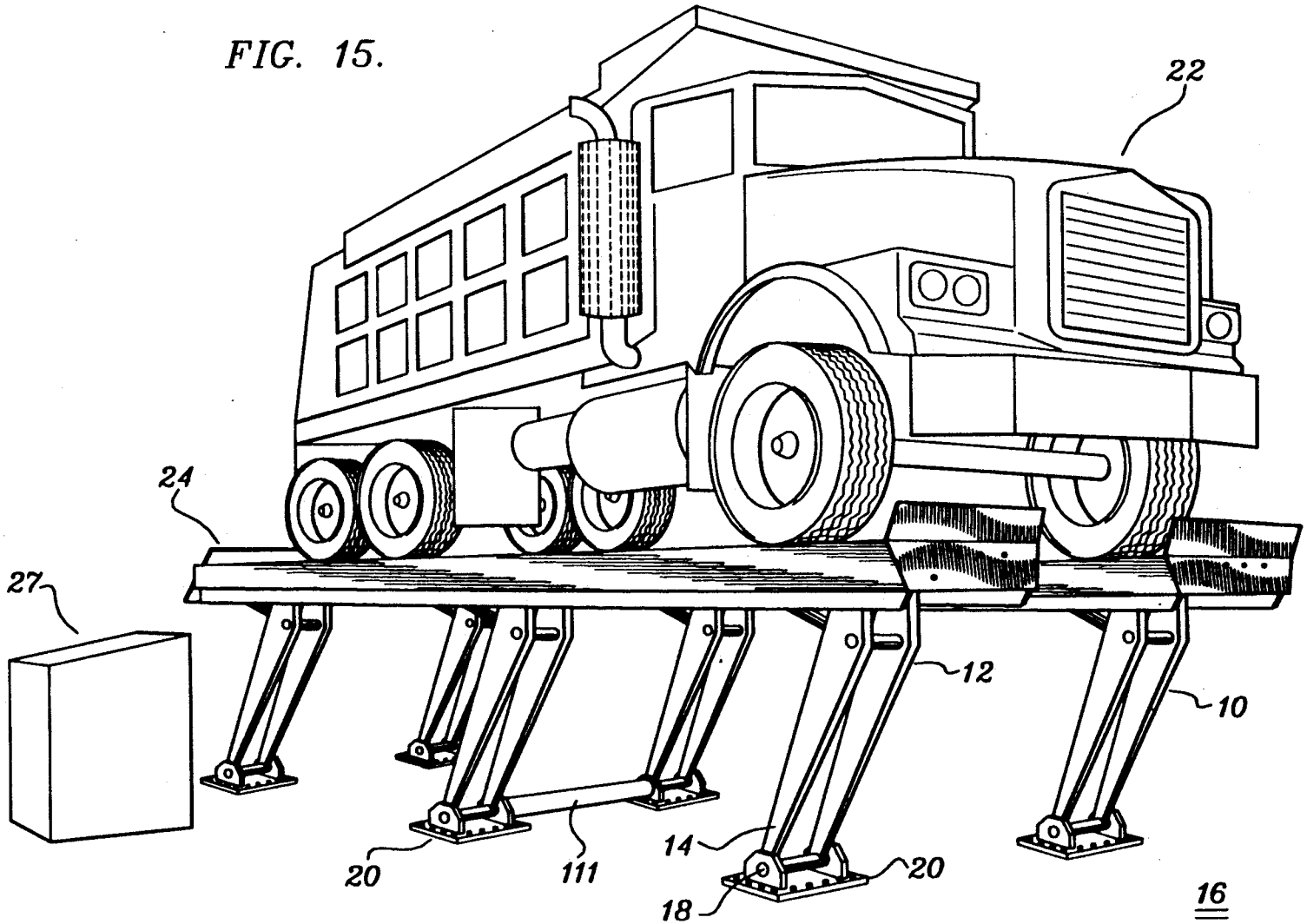
FIG. 15 is a perspective view, similar to FIG. 1, however, showing the use of a torsion bar with the system.

In FIG. 15 is shown the inventive system in which a torsion bar 111 has been added between the middle pair of bases 20. The function of bar 111 is to provide a slight tilt to one base 20 or the other to compensate for any unequal loading of the vehicle 22 that might exist. The general structure of such torsion bars is well known in the art, as is taught in U.S. Pat. No. 4,848,732 to Rossato.

There is, by the above, provided a vehicle lift system which, in addition to equalizing wheel platform heights at the tops of each leg, eliminates the need for torsion bars and provides ease of front-to-back and left-to-right access beneath an automotive vehicle that has been elevated.

Accordingly, while there has been shown and described the preferred embodiment of the present invention it is to be appreciated that the invention may be embodied otherwise that is herein specifically shown and described and that, within said embodiment, certain changes may be made within the form and arrangements of the parts without departing from the underlying idea or principles of this invention within the scope of the claims appended herewith.

Having thus described my invention what I claim as new, useful and non-obvious and, accordingly secure by Letters Patent of the United States is:

1. A non-continuous base ground level automotive lift system, comprising (a) a longitudinal plurality of transverse pairs of left and right rigid lifting legs, neither any legs of said pairs of legs nor any longitudinally successive legs having any on-ground connection therebetween, each of said legs having a top and a bottom, each bottom of each leg having, pivotally secured therewith, a planer base which is anchored upon an on-ground floor;

(b) left and right longitudinal vehicle wheel support platforms, said left and right wheel platforms having a pivotal connection relative to the respective tops of each of said respective pairs of left and right rigid legs; and (c) fluid piston and cylinder power means, within at least one pivotal connection within at least one each of said left and right pluralities of lifting legs, for selectively changing the length of the piston of said power means to correspondingly and synchronously modify the angulation between each piston, its corresponding lifting leg and its respective platform, to thereby synchronously control the height of the respective left and right platforms relative to each other.

2. The system as recited in claim 1, in which said bases of said legs comprise substantially a square having edge dimensions equal to about one-third of the maximum height of said lifting platform above said floor.

3. The system as recited in claim 2, in which the length of said lifting platform is in the range of 25 to 85 feet.

4. The system as recited in claim 3 in which said platform has a maximum height of about 60 inches above the floor.

5. The system as recited in claim 1 in which said bases further comprise leveling screws for changing an angle of the plane of each base relative to the floor.

6. The system as recited in claim 1, in which said power means for selectively changing the effective length of said piston comprises:

a fluid circuit having a blocked input pressure port, two output ports, a return tank and a proportioning valve respectively between said output ports and said return tank, in which one each of said output ports is in fluid communication with a respective one of said cylinder power means.

7. The system as recited in claim 6 in which said fluid circuit comprises:

(a) means for, during descent mode, selectively withdrawing fluid from that output port of the cylinder of the slower moving wheel platform, respective to said selective changing power means;

(b) means for, during ascent mode, selectively withdrawing fluid from that output port of the cylinder of the faster moving wheel platform, respective to said selective changing power means.

(c) means for returning said withdrawn quantity of fluid to said tank of the system; and (d) means for maintaining otherwise normal fluid operation of both of said output ports.

8. The system as recited in claim 7 further comprising:

means for imposing a maximum upon fluid flow through said that output port employed during ascent or descent mode.

9. The system as recited in claim 7, further comprising:

means for monitoring the relative movement of said cylinders, said means providing an input to said withdrawing means.

10. The system as recited in claim 1, further comprising:

a torsion bar operatively situated between left and right bases of at least one pair of left and right lifting legs.

11. The system as recited in claim 1 in which said on-ground floor comprises:

a floor having a recess relative to contiguous floor areas by about the height of the automotive lift system when collapsed.

* * * * *